US008023855B2

(12) United States Patent
Hattori et al.

(10) Patent No.: US 8,023,855 B2
(45) Date of Patent: Sep. 20, 2011

(54) DEVELOPMENT DEVICE, PROCESS CARTRIDGE, AND IMAGE FORMING APPARATUS

(75) Inventors: Yoshio Hattori, Kawasaki (JP); Keiichi Yoshida, Kawasaki (JP); Hiroyuki Uenishi, Sagamihara (JP)

(73) Assignee: Ricoh Company Limited, Tokyo (JP)

( * ) Notice: Subject to any disclaimer, the term of this patent is extended or adjusted under 35 U.S.C. 154(b) by 221 days.

(21) Appl. No.: 12/323,003

(22) Filed: Nov. 25, 2008

(65) Prior Publication Data

US 2009/0136257 A1 May 28, 2009

(30) Foreign Application Priority Data

Nov. 26, 2007 (JP) ..... 2007-304134

(51) Int. Cl.
*G03G 21/18* (2006.01)

(52) U.S. Cl. ..... 399/98; 399/91; 399/92; 399/93; 399/99; 399/107; 399/110; 399/111; 399/113; 399/119; 399/120

(58) Field of Classification Search ..... 399/92, 399/91, 93, 98, 99, 107, 110, 111, 113, 119, 399/120
See application file for complete search history.

(56) References Cited

U.S. PATENT DOCUMENTS

| | | | | |
|---|---|---|---|---|
| 5,887,227 | A * | 3/1999 | Kawai et al. | 399/98 |
| 6,393,241 | B1 | 5/2002 | Matsumoto et al. | |
| 6,501,913 | B2 | 12/2002 | Hattori et al. | |
| 6,507,720 | B2 | 1/2003 | Kabumoto et al. | |
| 6,567,637 | B2 | 5/2003 | Yanagisawa et al. | |
| 6,591,077 | B2 | 7/2003 | Yanagisawa et al. | |
| 6,628,908 | B2 | 9/2003 | Matsumoto et al. | |
| 6,665,508 | B2 | 12/2003 | Sudo et al. | |
| 6,748,190 | B2 | 6/2004 | Yanagisawa et al. | |
| 6,775,503 | B2 | 8/2004 | Hattori et al. | |
| 6,813,460 | B2 | 11/2004 | Sudo et al. | |
| 6,826,381 | B2 | 11/2004 | Muramatsu et al. | |
| 6,917,779 | B2 | 7/2005 | Fujimori et al. | |
| 7,010,249 | B2 | 3/2006 | Hattori | |
| 7,088,945 | B2 | 8/2006 | Matsumoto et al. | |
| 7,110,704 | B2 | 9/2006 | Sudo et al. | |
| 7,130,558 | B2 | 10/2006 | Matsumoto et al. | |
| 7,130,567 | B2 | 10/2006 | Sudo et al. | |
| 7,158,742 | B2 | 1/2007 | Sudo et al. | |
| 7,162,188 | B2 | 1/2007 | Sudo et al. | |
| 7,209,687 | B2 | 4/2007 | Sudo et al. | |
| 7,209,689 | B2 | 4/2007 | Matsumoto et al. | |
| 7,218,880 | B2 | 5/2007 | Yanagisawa et al. | |

(Continued)

FOREIGN PATENT DOCUMENTS

EP 0 807 865 A2 11/1997

(Continued)

*Primary Examiner* — David P Porta
*Assistant Examiner* — Shun Lee
(74) *Attorney, Agent, or Firm* — Oblon, Spivak, McClelland, Maier & Neustadt, L.L.P.

(57) ABSTRACT

A development device includes a developer carrier configured to carry developer and disposed in a development case, partly exposed from an opening of the development case facing an image carrier, a developer-transporting member configured to transport the developer to the developer carrier, and a discharging member housing a discharging space including a communicating path connecting to an area where the developer carrier faces the developer-transporting member, from which air is discharged into the discharging space, and a discharging port that opens in a longitudinal direction of the developer-transporting member, from which air is discharged from the discharging space.

20 Claims, 5 Drawing Sheets

U.S. PATENT DOCUMENTS

| | | | | |
|---|---|---|---|---|
| 7,289,748 | B2 | 10/2007 | Yanagisawa et al. | |
| 7,315,723 | B2 | 1/2008 | Suda et al. | |
| 7,356,290 | B2 | 4/2008 | Matsumoto et al. | |
| 7,412,191 | B2 | 8/2008 | Sudo et al. | |
| 2004/0052545 | A1* | 3/2004 | Satoh | 399/92 |
| 2005/0008398 | A1 | 1/2005 | Hattori | |
| 2005/0095028 | A1* | 5/2005 | Lee et al. | 399/98 |
| 2005/0196199 | A1 | 9/2005 | Hattori | |
| 2007/0081832 | A1 | 4/2007 | Yoshida et al. | |
| 2007/0104516 | A1 | 5/2007 | Katoh et al. | |
| 2007/0170211 | A1 | 7/2007 | Hattori | |

FOREIGN PATENT DOCUMENTS

| | | |
|---|---|---|
| JP | 04-368969 | 12/1992 |
| JP | 2003-295713 | 10/2003 |
| JP | 2006-003396 | 1/2006 |
| JP | 2006-139045 | 6/2006 |
| JP | 2007-121942 | 5/2007 |
| JP | 2007-140288 | 6/2007 |
| JP | 2007-148335 | 6/2007 |
| JP | 2007-178905 | 7/2007 |
| JP | 2007-178906 | 7/2007 |

* cited by examiner $$SF1 = \frac{(MXLNG)^2}{AREA} \times \frac{\pi}{4} \times 100$$

$$SF2 = \frac{(PERI)^2}{AREA} \times \frac{\pi}{4} \times 100$$

DEVELOPMENT DEVICE, PROCESS CARTRIDGE, AND IMAGE FORMING APPARATUS

CROSS-REFERENCE TO RELATED APPLICATIONS

This patent specification claims priority from Japanese Patent Application No. 2007-304134, filed on Nov. 26, 2007 in the Japan Patent Office, the entire contents of which are hereby incorporated by reference herein.

BACKGROUND OF THE INVENTION

1. Field of the Invention

The present invention relates to an image forming apparatus such as a copier, a printer, a facsimile machine, a plotter, a multi-function machine including at least two of these functions, and a digital direct reproducer, and a development device and a process cartridge used in the above-mentioned image forming apparatus.

2. Discussion of the Background

In general, an electronographic image forming apparatus, for example, a copier, a printer, a facsimile machine, etc., includes an image forming mechanism for forming an electrostatic latent image on an image carrier, developing the latent image with toner, transferring the developed image onto a recording medium, and fixing the image thereon.

Generally, a development device using two-component developer consisting essentially of toner and magnetic carrier includes a developer carrier and a developer-transporting member, both provided inside a development case having an opening facing the image carrier. The developer carrier is partially exposed from the opening, and carries the developer.

The developer-transporting member mixes and agitates the toner and the magnetic carrier in the development device, and transports the developer whose toner concentration is appropriately controlled. After the amount of the developer is set as appropriate by a developer regulator, the developer that is carried onto the developer carrier by the developer-transporting member is transported to a development area facing the image carrier. In the development area, the toner in the developer carried on the developer carrier is adhered to the electrostatic latent image formed on the image carrier to form a desired toner image.

In the development device performing an image forming operation, air flows in from the opening, and the developer carrier located at the position facing the opening and the developer-transporting member are revolved to generate airflow inside the development device. This airflow causes internal pressure of the development device to vary locally.

Most of the toner in the development device is adsorbed onto the magnetic carrier electrostatically due to frictional charging with the magnetic carrier. As noted above, however, in the development area, an electrical field generated between the image carrier and the development carrier causes the toner attracted onto the magnetic carrier to adhere instead to the electrostatic latent image on the image carrier. In other words, the strength of the electrical field exerted on the toner exceeds the electrostatic force attracting the toner to the magnetic carrier, and therefore the toner leaves the magnetic carrier and flies to the side of the image carrier.

However, the toner, which is a powder, does not have a consistent and uniform shape and consequently some toner have an insufficient ability to accept charge. If as a result the toner is distributed unevenly and remains in a part of the development device, such toner may be insufficiently charged because the frictional charging with the magnetic carrier may be insufficient.

Moreover, the magnetic carrier in the developer inside the development device loses its charging capability over time with repeated usage of the developer, and then fails to charge the toner sufficiently. Since insufficiently charged toner has weak attractive power and since the toner is light, the toner can be scattered by the airflow generated inside the development and scatter.

As the internal pressure of the development device increases, it can scatter the toner from openings in the components of the development device all over the interior of the image forming apparatus, contaminating the image forming apparatus.

Several proposals have been made to prevent the toner form escaping from the development device and scattering. For example, in known techniques, a development device includes a discharging port provided on an upper surface thereof that reduces internal pressure by discharging air from the development device, and a developer-supporting member, like a filter, that is provided on the discharging port catches developer that does escape, so that scattering of toner from the development device is prevented or reduced.

SUMMARY OF THE INVENTION

In view of the foregoing, one illustrative embodiment of the present invention provides a development device including a developer carrier configured to carry developer and disposed in a development case, partly exposed from an opening of the development case facing an image carrier, a developer-transporting member configured to transport the developer to the developer carrier, and a discharging member housing a discharging space including a communicating path connecting to an area where the developer carrier faces the developer-transporting member, from which air is discharged into the discharging space, and a discharging port that opens in a longitudinal direction of the developer-transporting member, from which air is discharged from the discharging space.

Another illustrative embodiment of the present invention provides a process cartridge configured to be removably insertable into image forming apparatus and accommodate an image carrier and at least one unit selected from a group including a charging mechanism configured to charge the image carrier evenly, a cleaning mechanism configured to clean the image carrier, and a development device as described above.

Another illustrative embodiment of the present invention provides an image-forming apparatus including a charging mechanism configured to charge evenly an image carrier, a latent-image forming mechanism configured to form a latent image on the image carrier, a cleaning mechanism configured to clean the image carrier, and a development device as described above.

BRIEF DESCRIPTION OF THE DRAWINGS

A more complete appreciation of the disclosure and many of the attendant advantage thereof will be readily obtained as the same becomes better understood by reference to the following detailed description when considered in connection with the accompanying drawings, wherein.

DETAILED DESCRIPTION OF PREFERRED EMBODIMENTS

Figure 1:
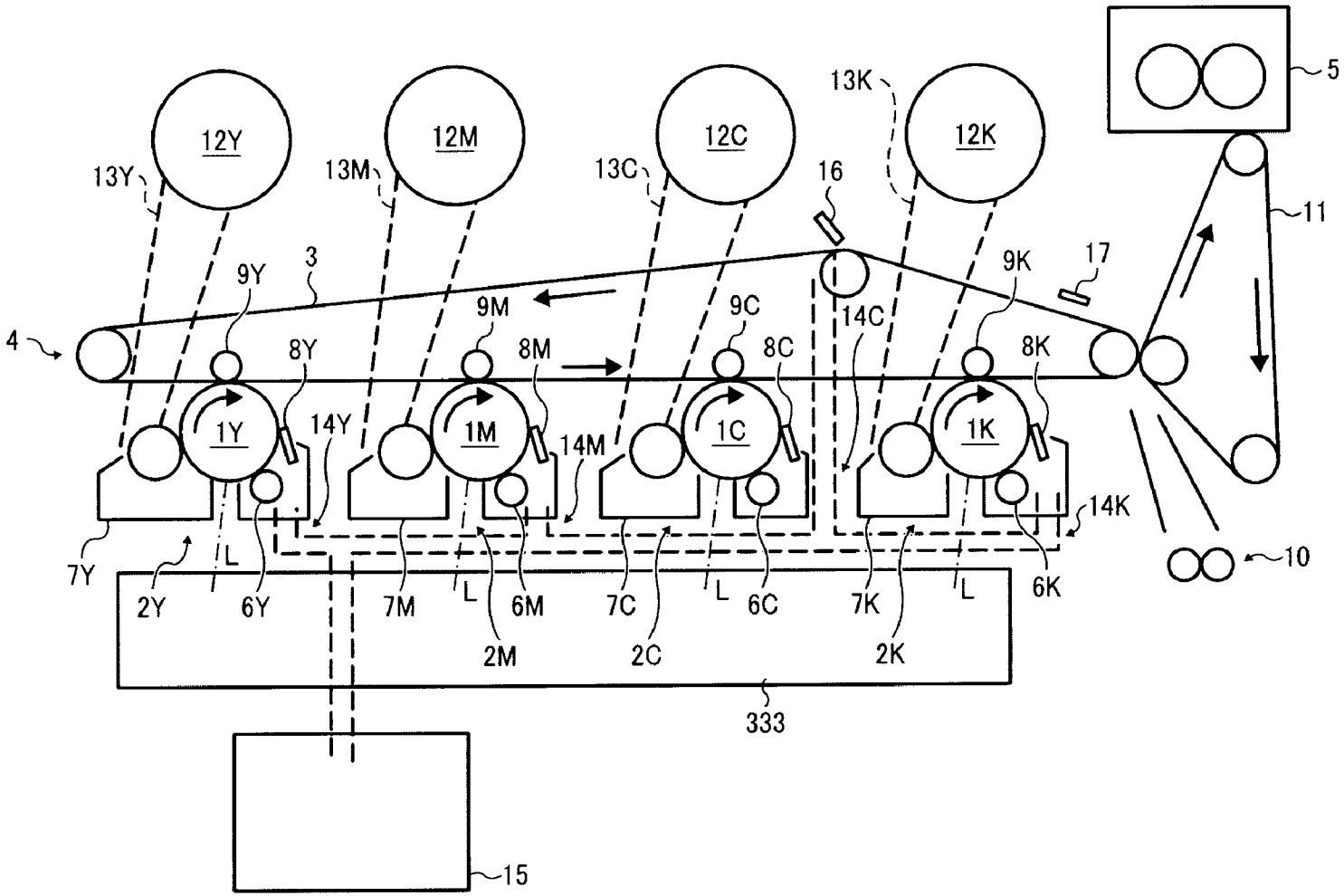
FIG. 1 is an overall schematic view illustrating an example of an image forming apparatus according to one illustrative embodiment of the present invention.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, an image forming apparatus that is a full color printer (hereinafter referred to as a printer) according to an illustrative embodiment of the present invention is described. It is to be noted that although the image forming apparatus of the present embodiment is a printer, the image forming apparatus of the present invention is not limited to a printer.

Figure 2:
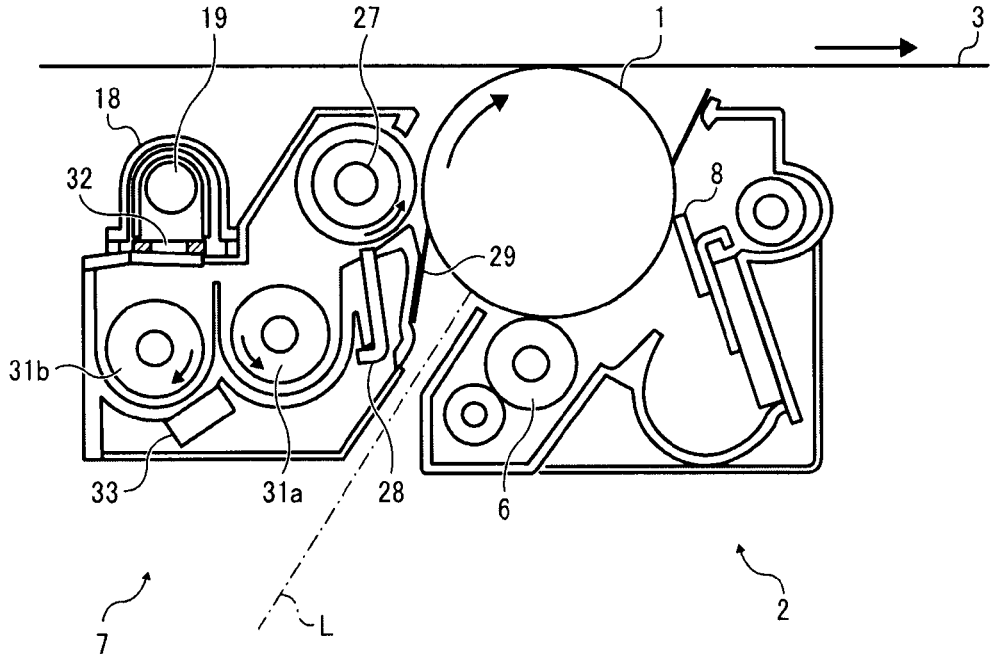
FIG. 2 is a diagram illustrating a configuration of an image-forming unit of the image forming apparatus shown in FIG. 1.

FIG. 1 is a schematic diagram illustrating a configuration of the printer, and FIG. 2 is a schematic diagram illustrating a configuration of an image-forming unit that is a component of the printer.

Referring to FIG. 1, the printer is equipped with image forming units 2Y, 2M, 2C, and 2K that are respectively provided with photoreceptors 1Y, 1M, 1C, and 1K that serve image carriers on which yellow, magenta, cyan, and black toner images are formed. Further, the printer is provided with an optical writing unit 333 serving as a latent-image forming mechanism that scans the photoreceptors 1Y, 1M, 1C, and 1K with laser lights L modulated based on image information, and thus electrostatic latent images are formed on the photoreceptors 1Y, 1M, 1C, and 1K. Moreover, the printer is provided with an intermediate transfer unit 4 that transfers toner images from the photoreceptors 1Y, 1M, 1C, and 1K and superimposes them one on another on a transfer sheet via an intermediate transfer belt 3, and a fixing unit 5 that fixes the superimposed toner image on the transfer sheet.

It is to be noted that the subscripts Y, M, C, and K attached to the end of each reference numeral indicate only that components indicated thereby are used for forming yellow, magenta, cyan, and black images, respectively, and hereinafter may be omitted when color discrimination is not necessary.

A configuration of the image-forming unit 2 is described below with reference to FIG. 2. It is to be noted that, although the four image-forming units 2Y, 2M, 2C, and 2K respectively use different color toners, for forming Y, M, C, and K images, all other configurations thereof are the same or similar, and thus the subscripts Y, M, C, and K are omitted in FIG. 2.

Referring to FIG. 2, each of the image-forming units 2 includes a charging device 6, a development device 7, a photoreceptor-cleaning device 8, and a discharging device, not shown, provided around the photoreceptor 1 shaped as a drum.

The charging device 6 evenly charges a surface of the photoreceptor 1 that is rotated by a driving unit, not shown, and then the evenly charged surface of the photoreceptor 1 is exposed to the laser light L, and carries the electrostatic latent image.

The development device 7 develops the electrostatic latent image on the photoreceptor 1 into a toner image, and then, the toner image formed on the photoreceptor 1 is primarily transferred onto the intermediate transfer belt 3.

The photoreceptor-cleaning device 8 removes toner that remains on the photoreceptor 1 after a toner image is transferred therefrom.

Referring to FIG. 1, in the intermediate transfer unit 4, the toner images formed on each of the photoreceptors 1Y, 1M, 1C, and 1K is transferred therefrom with a transfer bias that is applied by each of transfer bias rollers 9Y, 9M, 9C, and 9K, and are sequentially superimposed one on another on the intermediate transfer belt 3.

The four-color superimposed toner image formed on the intermediate transfer belt 3 is transferred by a paper-transfer belt 11 onto the transfer sheet that is passed though a pair of registration rollers 10 and is transported to a transfer position. The transfer sheet on which the toner image is transferred is transported to the fixing unit 5 by the paper-transfer belt 11, where the toner image is fixed with heat, and then discharged from the printer.

Further, the printer according to the present embodiment is equipped with toner bottles 12Y, 12M, 12C, and 12K that respectively contain unused yellow, magenta, cyan, and black toner. The unused toner filling the toner bottles 12Y, 12M, 12C, and 12K is supplied as appropriate to the development devices 7Y, 7M, 7C, and 7K by toner-supplying devices 13Y, 13M, 13C, and 13K, respectively.

Moreover, the printer according to the present embodiment is equipped with a pattern detector 17 that detects a pattern image formed on the intermediate transfer belt 3 for process control, and a waste-toner container 15 that contains used toner collected from the image-forming units 2 and the intermediate transfer unit 4. The untransferred, residual toner that is removed from the image-forming units 2 by the photoreceptor-cleaning device 8 is passed through collected-toner transport routes 14 (Y, M, C, K) to be collected in the waste-toner container 15. In the intermediate transfer unit 4, the untransferred toner and the pattern image removed from the intermediate transfer belt 3 by a belt-cleaning blade 16 are passed through the collected-toner transport route 14 to be collected in the waste-toner collected container 15.

The development device 7 is described below in further detail.

Referring to FIG. 2, a development roller 27 is disposed next to the photoreceptor 1 as a developer carrier. Further, on the upstream side in a direction in which a surface of the development roller 27 moves from a development area, a development doctor blade 28 as a developer regulator to control a thickness of a developer layer is provided.

On the right of the development doctor blade 28 in FIG. 2, an entrance seal 29 to prevent the toner scattering from the development area (hereinafter "scattering toner") is provided.

Beneath the development roller 27, a first developer-transporting screw 31*a* and a second developer-transporting screw 31*b* are disposed in parallel. The development device 7 further includes a toner concentration sensor 33, and a toner hopper 18 that contains the powder toner is disposed above the second developer-transporting screw 31*b*. The toner hopper 18 includes a toner-supplying screw 19 to supply the toner and a toner-supplying port 32 through which the toner is supplied from the toner bottle 12 by the toner-supplying device 13.

Figure 3:
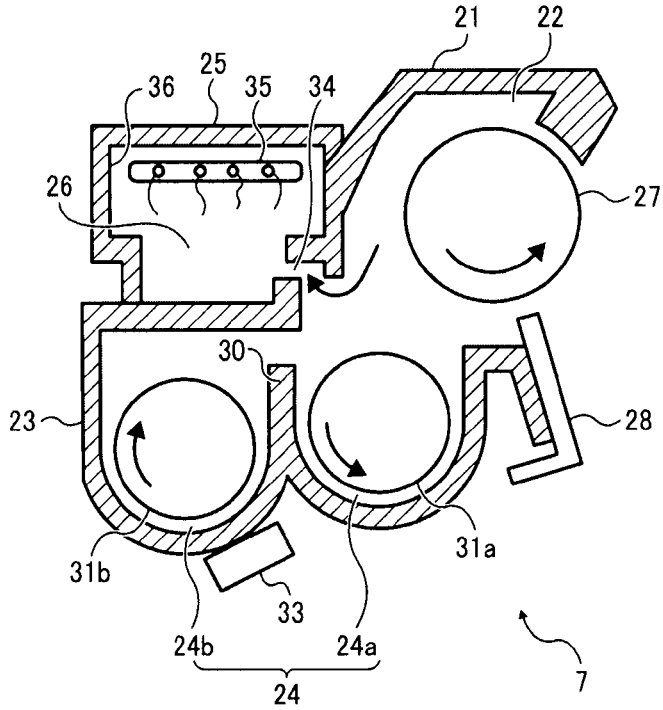
FIG. 3 is a cross-sectional diagram illustrating a configuration of a development device of the image-forming unit shown in FIG. 2.
Figure 4:
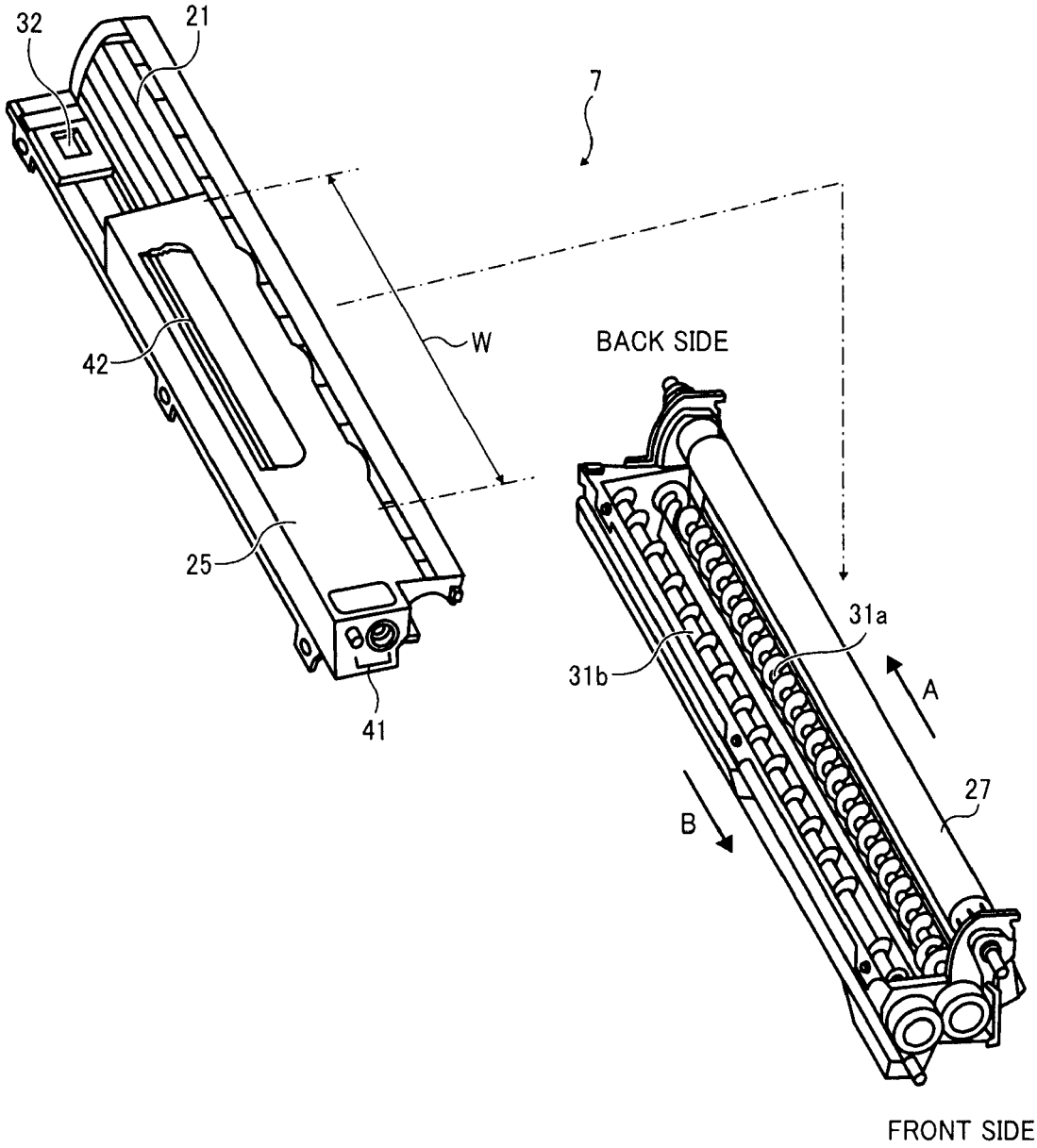
FIG. 4 is an exploded perspective view illustrating the configuration of the development device.

FIG. 3 is a cross-section, end-on diagram illustrating an example of a configuration of the development device 7, and FIG. 4 is a perspective view that schematically shows components of the development device 7. It is to be noted that the development devices 7Y, 7M, 7C, and 7K have the same or similar configuration expect for the color of the toner used therein, and thus the subscripts Y, M, C, and K are omitted in the description below.

Referring to FIG. 3, the development device 7 further includes a development roller container 22 as a developer carrier container formed with an upper case 21, a developer container 24 formed with a lower case 23, and a pressure release space 26 as an air-discharging space formed with a pressure release case 25.

The development roller container 22 contains the development roller 27 as the developer carrier, exposes a part of the development roller 27 from an opening portion of the upper case 21, and forms the development area between the development roller container 22 and the photoreceptor 1.

The developer container 24 contains two-component developer including the toner and carrier. The developer container 24 is separated by a partition wall 30 into two spaces, a first developer container 24*a* including the first developer-transporting screw 31*a*, and a second developer container 24*b* including the second developer-transporting screw 31*b*.

Further as shown in FIG. 2, the toner-supplying port 32 is located above an upstream side end portion of the second developer-transporting screw 31*b* in a direction in which the second developer-transporting screw 31*b* transports the developer (hereinafter "developer transport direction"). Moreover, the toner concentration sensor 33 is disposed beneath an upstream side end portion of the second developer container 24*b* in a direction in which the developer is transported therein and detects toner concentration in the developer container 24. The toner-supplying device 13 supplies an appropriate amount of the toner into the developer container 24 through the toner-supplying port 32 based on detection results generated by the toner concentration sensor 33.

The pressure release space 26 is equipped with a communicating path 34 that connects to an area in which the development roller 27 faces the first developer-transporting screw 31*a*, and a discharging port 35 that opens in a longitudinal direction of the second developer-transporting screw 31*b* and releases inner air to the outside. An inner surface of a wall of the pressure release case 25 is provided with an adhesive layer 36 serving as a toner catcher that catches the scattering toner. As shown in FIG. 4, the development device 7 further includes a lever 41 and a unit-holding portion 42Y, which are described below with reference to FIG. 6.

In the development device 7 having the configuration described above, referring to FIG. 4, the developer including the carrier and the toner in the developer container 24 is agitated and transported in a direction indicated by arrow B by the second developer-transporting screw 31*b*. Then, the developer transported by the second developer-transporting screw 31*b* passes through an opening provided in an end portion of the partition wall 30, and is agitated and transported in a direction indicated by arrow A by the first developer-transporting screw 31*a*. Further, the developer passes through an opening provided in another end portion of the partition wall 30 and is transported by the second developer-transporting screw 31*b*. Thus, the developer is circulated within the developer container 24 by the first developer-transporting screw 31*a* and the second developer-transporting screw 31*b*.

In the developer agitated and transported by the first developer-transporting screw 31*a* in the first developer container 24*a*, the carrier is attracted by a magnetic roller built into the development roller 27, and thus carried on the development roller 27.

Further, while the toner in the developer is agitated with the carrier, the toner is charged to a polarity opposite that of the carrier, and accordingly an electrostatic force is created between the carrier and the toner. Therefore, the toner is carried on the development roller 27 with the carrier.

The thickness of the layer of the developer carried on the development roller 27 is adjusted as the developer passes through a doctor gap formed between the development doctor 28 and the surface of the development roller 27. Subsequently, the developer whose layer thickness is adjusted is transferred to the development area facing the photoreceptor 1 (shown in FIG. 2), where the developer stands on end on the development roller 27 due to the magnetic force exerted by the magnetic roller.

Then, the erect carrier on the development roller 27 supplies the toner on a surface thereof to the surface of the photoreceptor 1, while slidingly contacts the surface of the photoreceptor 1. At this time, the development roller 27 receives the image bias by a power supply, not shown, which generates a development electric field in the development area.

Therefore, between the electrostatic latent image on the photoreceptor 1 and the development roller 27, the electrostatic force toward the side of the electrostatic latent image acts on the toner on the development roller 27, and thus the toner on the development roller 27 adheres to the electrostatic latent image. That is, the electrostatic latent image on the photoreceptor 1 is developed with the toner thus adhered thereto into the toner image whose color corresponds to that of the toner.

As the toner is consumed by the development, fresh toner is supplied by the toner-supplying device 13. The toner-supplying device 13 temporarily stores the new toner supplied from the toner bottle 12 in the toner hopper 18 (shown in FIG. 2) that is located on a back side of the printer body.

Then, when the toner concentration sensor detects that the toner concentration in the second developer container 24*b* is insufficient, the toner-supplying device 13 causes the toner-supplying screw 19 in the toner hopper 18 to rotate for a time determined according to a prescribed formula. As a result, the toner-supplying device 13 supplies the appropriate amount of the developer from the toner hopper 18 to the second developer container 24*b* via the toner-supplying port 32. The toner supplied in the second developer container 24*b* is agitated with the carrier by the second developer-transporting screw 31*b*, and used to develop the latent image, being circulated within the developer container 24, as described above.

Additionally, sensing of the amount of the toner remaining in the toner bottle 12 is done by a toner sensor, not shown, provided on the toner hopper 18. The toner hopper 18 is equipped with a toner sensor, not shown, that senses the amount of the toner remaining in the toner bottle 12. When the toner sensor fails to detect the presence of any toner, the toner sensor requests the toner-supplying device 13 to supply the toner. When the toner sensor continues to fail to detect the presence of the toner after the toner sensor maintains its request for a certain time period, the toner sensor determines that there is no toner in the toner bottle 12 shown in FIG. 1.

In a series of operations performed by the development device 7 as the development roller 27 rotates, the air from the opening in the upper case 21 passes through the area between the upper case 21 and development roller 27 and reaches the communicating path 34 leading to the pressure release space 26. Then, the air that reaches the pressure release space 26 from the communicating path 34 is discharged from the discharging port 35 in a longitudinal direction of the first and second developer-transporting screws 31*a* and 31*b*.

The scattering toner in the development device 7 rides the airflow formed in the development device 7 mentioned above, and enters the pressure release space 26. Since the space 26 is not provided with a rotation member such as the development roller 27 and the developer-transporting screw 31, and is larger than the development roller container 22, it is less likely that the pressure release space 26 generates airflow faster than that in the foregoing space.

Consequently, when air and the scattering toner are introduced into the pressure release space 26 and then discharged from the discharging port 35, the amount of the toner that scatters from the discharging port 35 is smaller than when the scattering toner is directly discharged from the communicating path 34. That is, the pressure release space 26 can keep and isolate the scattering toner from spaces a user touches.

Further, because the discharging port 35 opens in the longitudinal direction of the first and second developer-transporting screws 31*a* and 31*b*, if the toner does manage to scatter from the discharging port 35, the scattering route of the scattering toner can be limited to not a vertical direction of the development device 7 but only a longitudinal direction of the development device 7.

It is to be noted that it is not necessarily advantageous that the communicating path 34 that is connected to the pressure release space 26 be relatively wide. For example, maintaining a uniform airflow distribution is difficult if the communicating path 34 extends throughout in the first developer-transporting screw 31*a* the longitudinal direction because partial turbulence and backflow can be generated. Therefore, in the present embodiment, the communicating path 34 connected to the pressure release space 26 does not extend the entire length in the longitudinal direction of the first developer-transporting screw 31*a* but is instead limited to an area sufficient to effectively control scattering of the toner.

As shown in FIG. 4, the communicating path 34 connected to the pressure release space 26 does not extend throughout the longitudinal direction of the first developer-transporting screw 31*a* but is limited to an area W close to an upstream side end portion of the first developer-transferring screw 31*a* in the direction in which the developer is transported. Most of the developer flowing through a downstream portion in the developer transport direction of the first developer-transporting screw 31*a*, that is, on a back side in FIG. 4, is developer that has finished a developing operation and consumed the toner, and thus the toner concentration thereat is lower than that on the upstream side.

On the downstream side of the developer transport direction of the first developer-transporting screw 31*a*, the developer is sufficiently agitated until the developer reaches the downstream side, and thus the amount of electrical charge on the toner is comparatively high, and the toner is less likely to scatter.

By contrast, on the upstream side in the developer transport direction of the first developer-transporting screw 31*a*, the toner scatters easily. Consequently, in the present embodiment, an opening area of the communicating path 34 is located on the upstream side of the first developer-transporting screw 31*a*; therefore it is possible to generate relatively strong and stable discharging airflow on the upstream where the toner scatters easily.

An upstream side end portion of the communicating path 34 is close to a starting point of the area in which the development roller 27 faces the first developer-transporting screw 31*a* in the direction in which the developer is transported, and as a result, the distance from the communicating path 34 is longer on the downstream side in the developer transport direction of the first developer-transporting screw 31*a*. Therefore, although the airflow is weaker on the downstream side than on the upstream side, the toner scatters less for the foregoing reason.

By contrast, though the toner easily scatters on the upstream side, by forming the relatively strong airflow, the toner scattering can be effectively controlled.

Further, in the present embodiment, the adhesive layer 36, as a toner-containing member, is disposed on the interior of the pressure release case 25. The adhesive layer 36 catches the scattering toner that enters the pressure release case 25 passing through the communicating path 34, and prevents the scattering toner from being discharged from the pressure release space 26. By this means, the scattering toner is securely isolated from places the user touches.

Figure 5:
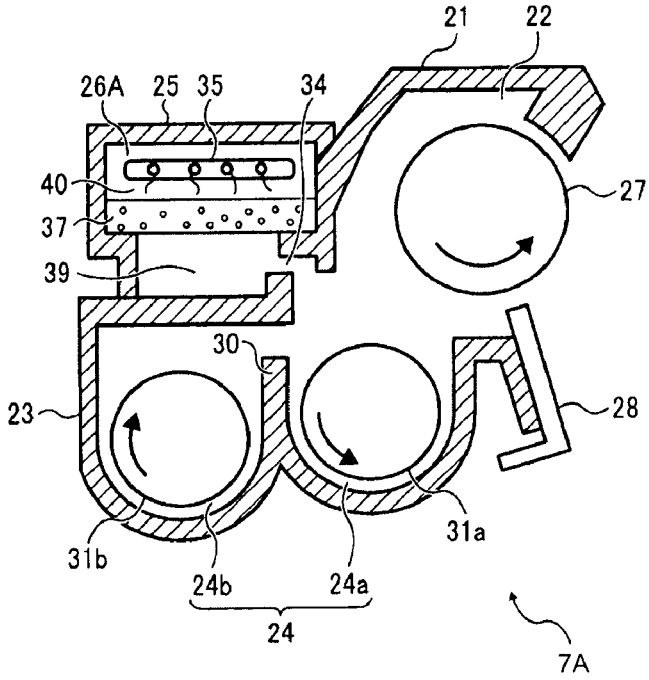
FIG. 5 is a cross-sectional diagram illustrating a configuration of a development device according to another embodiment.

FIG. 5 is a schematic view illustrating a development device according to another embodiment of the present invention. In FIG. 5, members identical or similar to the members shown in FIG. 3 are indicated by the same reference numerals, and a description thereof is omitted. Although in FIG. 3 the pressure release space 26 is provided with the adhesive layer 36 as the toner catcher, alternatively, as shown in FIG. 5, a pressure release space 26A may be provided with a filter 37 as a toner catcher.

The filter 37 filters the toner from the air and prevents it from discharging. In this way, the scattering toner that enters in the pressure release space 26A is securely blocked by the filter 37, and the toner cannot be discharged from the pressure release space 26A. That is, the filter 37 works as a toner-blocking member, and can reliably isolate the scattering toner from the place where the user touches.

In order to take full advantage of the effect of the filter 37, it is preferable to provide a space 39 between a communicating path 34 and the filter 37 and a space 40 between the filter 37 and a discharging port 35. Providing a sufficiently large filter surface for the filter 37 prevents the toner from clogging the filter 37.

Additionally, in the image-forming unit 2, the photoreceptor 1, the charging device 6, the development device 7 shown in FIG. 3 or the development device 7A shown in FIG. 5, and the photoreceptor-cleaning device 8 shown in FIG. 1 are held in a common unit casing, that is, the image-forming unit 2 is configured as a removably insertable process cartridge in the printer body. Alternatively, the photoreceptor and at least one of the charging device 6, the development device 7 or 7A, the photoreceptor-cleaning device 8, and the discharging device that removes the electrical charge remaining on the photoreceptor 1 can be integrated into a single process cartridge as a unit.

Figure 6:
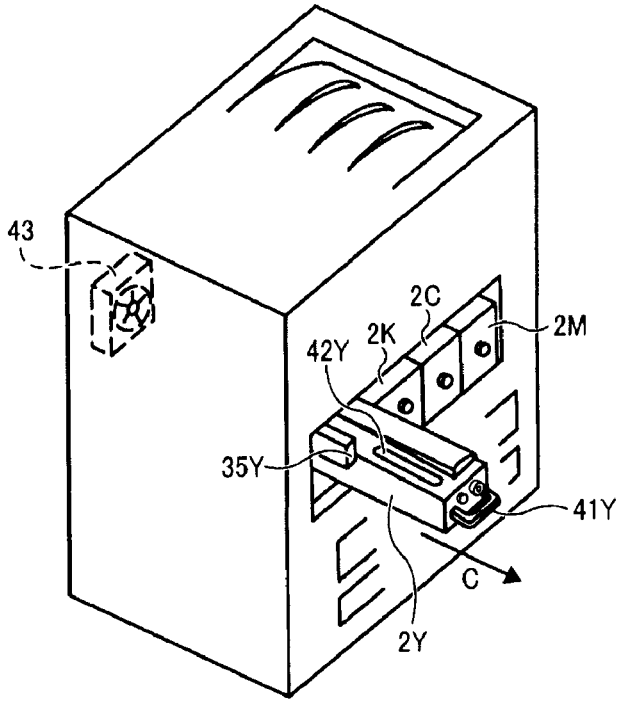
FIG. 6 is a perspective view illustrating insertion of the image-forming unit to the image forming apparatus body.

FIG. 6 is a perspective view schematically illustrating insertion of the image-forming unit 2, configured as a process cartridge, in the printer body.

Referring to FIG. 6, the user pulls the lever 41Y disposed on the front side of the image-forming unit 2Y in a direction indicated by arrow C in FIG. 6 to withdraw the image-forming unit 2Y from the printer body. The user can hold the image-forming unit 2Y by holding the unit-holding portion 42Y located on an upper surface of the image-forming unit 2Y.

Thus, because the image-forming unit 2Y is configured to be removable from the main body of the printer, when maintenance is needed, the user only needs to exchange the image-forming unit 2; therefore, the convenience is enhanced. It is to be noted that, for ease of illustration, in FIG. 6 only the image-forming unit 2Y is shown; the other image-forming units, 2M, 2C, and 2K, are omitted.

Referring to FIG. 6, when the image-forming unit 2 is configured to be removably insertable into the printer, the discharging port 35 located in the pressure release space 26 or 26A in the development device 7 or 7A is disposed distally at a back side portion in a direction of insertion of the image-forming unit 2. It is preferable that the printer body be equipped with at least one airflow fan 43 located on the back side in the direction indicated by arrow C. Additionally, it is preferable that the airflow fan 43 be disposed in a position facing the discharging port 35 in the pressure release space 26.

The airflow fan 43 can control an increase in temperature of the printer parts, and cause the airflow discharged from the discharging port 35 via the pressure release space 26 to flow toward the back side of the image-forming unit 2. If the air discharged from the discharging port 35 includes the scattering toner, the route of the scattering toner can be limited to that toward the back side of the image-forming unit 2.

As a result, the airflow fan 43 can prevent the scattering toner from adhering to the lever 41 disposed on the front side of the image-forming unit 2, and the unit-holding portion 42 disposed on the upper surface of the image-forming unit 2.

The toner is described below with reference to FIGS. 7 and 8.

In the printer according to the present embodiment, to attain high quality images, the toner used in development desirably has a first shape factor SF1 and a second shape factor SF2 both within a range of 100 to 180. The first shape factor SF1 is explained with reference to FIG. 7, and the second shape factor SF2 is explained with reference to FIG. 8.

Figure 7:
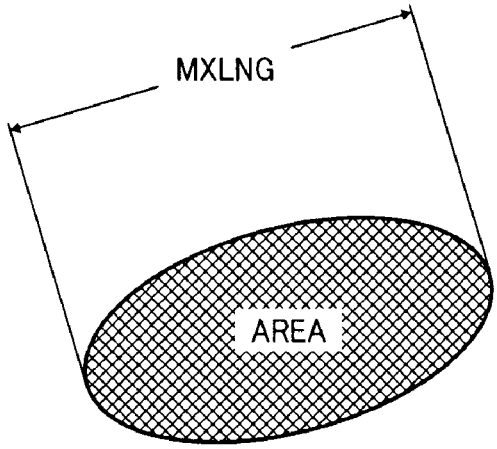
FIG. 7 is a schematic diagram illustrating a configuration of toner to describe a first shape factor SF1.

Referring to FIG. 7, the first shape factor SF1 shows a degree of roundness, and is expressed by formula 1:

$$SF1=\{(MXLNG)^2/AREA\}\times(100\pi/4) \quad (1)$$

wherein MXLNG is a maximum length of a toner particle projected on a two-dimensional surface and AREA is an area of the toner particle.

The toner particle is a sphere when the first shape factor SF1 is 100. The larger the SF1 becomes, the more the toner particle becomes amorphous.

Figure 8:
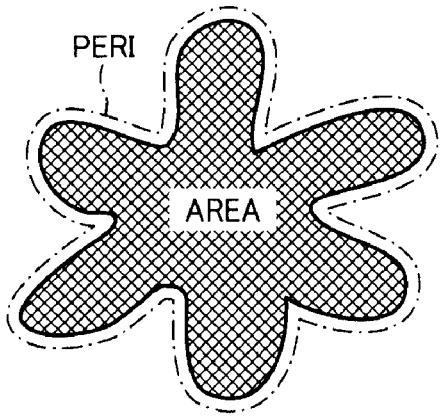
FIG. 8 is a schematic diagram illustrating another configuration of the toner to describe a second shape factor SF2.

Referring to FIG. 8, the second shape factor SF2 shows a degree of irregularity and is expressed by formula 2:

$$SF2=\{(PERI)^2/AREA\}\times(100\pi/4) \quad (2)$$

wherein PERI is a peripheral length of a toner particle projected on a two-dimensional surface and AREA is the area of the toner particle.

The toner particle is flat when the first shape factor SF1 is 100. The larger the first shape factor SF1 becomes, the more the toner particle has irregularities.

The first shape factor SF1 and second shape factor SF2 can be measured by taking a photograph using a scanning electron microscope, S-800 (Hitachi, Ltd.) and analyzing the photograph using an image analyzer, LUSEX3 (NIRECO CORPORATION).

It is to be noted that although in the present embodiment the color printer equipped with the four image-forming unit, 2Y, 2M, 2C, and 2K as shown in FIG. 1 is described, the present invention can be applied to a monochrome printer equipped with only one image forming unit shown in FIG. 2 and a bicolor printer equipped with two image forming units shown in FIG. 2.

As described above, the development device 7 according to the embodiments of the present invention can keep away the scattering toner from the portions that the user touches by containing the scattering toner in the pressure release space 26 as a discharging place. As a result, the user can change the development device 7 without touching the scattering toner, thereby facilitating maintenance of the development device 7.

Further, in the development device 7 according to the embodiments of the present invention, the communicating path 34 connecting to the pressure release space 26 is formed in the specific area W that extends from the upstream side end portion of the first developer-transferring screw 31*a* in the direction in which the developer is transported.

Because an upstream side in the direction in which the first developer-transferring screw 31*a* transports developer is where the supplied toner tends to be insufficiently dispersed and insufficiently charged, the communicating path 34 as an entrance to the pressure release space is disposed in that area to efficiently control scattering of the toner.

Further, because the development device 7 according to the embodiment described above is equipped with the adhesive layer 36 as the toner catcher in the pressure release space 26, the pressure release space 26 can reliably retain the scattering toner.

Additionally, because the development device 7 according to the present embodiment is equipped with the filter 37 in the pressure release space 26 as the toner catcher, the pressure release space 26 can reliably retain the scattering toner.

Because the development device 7 according to the present embodiment is equipped with the spaces both side of the filter 37 in the pressure release place 26, the discharging of the air and the holding of the scattering toner can be efficiently operated.

The image-forming unit 2 according to the present embodiment is configured as a process cartridge including the development device described above. Therefore, when the user changes the image forming unit, the user's skin and clothes are not contaminated by the scattering toner, and maintenance is easy.

In the printer according to the present embodiment, the discharging port 35 in the pressure release space 26 is located on the back side in the direction of insertion of the image-forming unit 2, which can limit a direction of the scattering toner from the discharging port 35 to a direction far from the portions that the user can touch.

In the printer according to the present embodiment, because the airflow fan 43 as an airflow-generating unit is disposed on back side in the direction of insertion of image-forming unit 2, a direction in which the toner scatters from the discharging port 35 can be comparatively easy to control.

According to the present embodiment, scattering of the toner can be reduced also when images of a relatively high image area ratio are output and when the printer is a color printer equipped with the multiple development devices 7 and the multiple image-forming units 2 as described above.

Numerous additional modifications and variations are possible in light of the above teachings. It is therefore to be understood that, within the scope of the appended claims, the disclosure of this patent specification may be practiced otherwise than as specifically described herein.

What is claimed is:

1. A development device comprising:

a developer carrier configured to carry developer and disposed in a development case, partly exposed from an opening of the development case facing an image carrier;

a developer-transporting member configured to transport the developer to the developer carrier and including two developer-transporting screws; and a discharging member housing a pressure release space separated from the developer-transporting member by a case and including a communicating path connecting to an area where the developer carrier faces the developer-transporting member, from which air is discharged into the pressure release space, a discharging port that opens in a longitudinal direction of the developer-transporting member being situated inside the pressure release space, air being discharged from the pressure release space via the discharging port, the communicating path having a length smaller than a length of the developer-transporting member in the longitudinal direction of the developer-transporting member.

2. The development device according to claim 1, wherein the communicating path is located in an area above an upstream side of one of the developer-transporting screws of the developer-transporting member in a direction in which the developer-transporting screw transports the developer.

3. The development device according to claim 1, further comprising a toner catcher that catches toner scattering in the pressure release space.

4. The development device according to claim 3, wherein the toner catcher is an adhesive layer disposed on an inner wall of the discharging member.

5. The development device according to claim 3, wherein the toner catcher is a filter.

6. The development device according to claim 5, wherein spaces are respectively provided between the communicating path and the filter, and between the filter and the discharging port.

7. The development device according to claim 1, further comprising a toner concentration sensor configured to detect toner concentration in a container housing the two developer-transporting screws.

8. A process cartridge configured to be removably insertable into an image forming apparatus and accommodate an image carrier and a group of units including:

a charging mechanism configured to charge the image carrier evenly;

a cleaning mechanism configured to clean the image carrier; and a development device configured to develop a latent image formed on the image carrier and including:

a developer carrier configured to carry developer and disposed in a development case, partly exposed from an opening of the development case facing the image carrier;

a developer-transporting member configured to transport the developer to the developer carrier and including two developer-transporting screws; and a discharging member housing a pressure release space separated from the developer-transporting member by a case and including a communicating path connecting to an area where the developer carrier faces the developer-transporting member, from which air is discharged into the pressure release space, a discharging port that opens in a longitudinal direction of the developer-transporting member being situated inside the pressure release space, air being discharged from the pressure release space via the discharging port, the communicating path having a length smaller than a length of the developer-transporting member in the longitudinal direction of the developer-transporting member.

9. The process cartridge according to claim 8, wherein the communicating path of the development device is located in an area above an upstream side of one of the developer-transporting screws of the developer-transporting member in a direction in which the developer-transporting screw transports the developer.

10. The process cartridge according to claim 8, wherein the development device further comprising a toner catcher that catches toner scattering in the pressure release space.

11. The process cartridge according to claim 10, wherein the toner catcher of the development device is an adhesive layer disposed on an inner wall of the discharging member.

12. The process cartridge according to claim 10, wherein the toner catcher of the development device is a filter.

13. The process cartridge according to claim 12, wherein spaces of the development device are respectively provided between the communicating path and the filter, and between the filter and the discharging port.

14. An image-forming apparatus comprising:

a charging mechanism configured to charge evenly an image carrier;

a latent-image forming mechanism configured to form a latent image on the image carrier;

a cleaning mechanism configured to clean the image carrier; and a development device configured to develop the latent image on the image carrier, comprising:

a developer carrier configured to carry developer and disposed in a development case, partly exposed from an opening of the development case facing the image carrier;

a developer-transporting member configured to transport the developer to the developer carrier and including two developer-transporting screws; and a discharging member housing a pressure release space separated from the developer-transporting member by a case and including a communicating path connecting to an area where the developer carrier faces the developer-transporting member, from which air is discharged into the pressure release space, a discharging port that opens in a longitudinal direction of the developer-transporting member being situated inside the pressure release space, air being discharged from the pressure release space via the discharging port, the communicating path having a length smaller than a length of the developer-transporting member in the longitudinal direction of the developer-transporting member.

15. The image-forming apparatus according to claim 14, wherein the communicating path of the development device is located in an area above an upstream side of one of the developer-transporting screws of the developer-transporting member in a direction in which the developer-transporting screw transports the developer.

16. The image forming apparatus according to claim 14, wherein the development device further comprising a toner catcher of the development device that catches toner scattering in the pressure release space.

17. The image-forming apparatus according to claim 16, wherein the toner catcher of the development device is an adhesive layer disposed on an inner wall of the discharging member.

18. The image forming apparatus according to claim 16, wherein the toner catcher of the development device is a filter.

19. The image-forming apparatus according to claim 18, wherein spaces of the development device are respectively provided between the communicating path and the filter, and between the filter and the discharging port.

20. The image-forming apparatus according to claim 14, further comprising an airflow fan configured to cause a flow of air discharged from the discharging port to a back side of the image-forming apparatus.

* * * * *